US010077542B2

(12) United States Patent
Emmerson

(10) Patent No.: US 10,077,542 B2
(45) Date of Patent: Sep. 18, 2018

(54) DEMOUNTABLE VEHICLE IMPLEMENT

(71) Applicant: Pearson Engineering Ltd, Newcastle upon Tyne (GB)

(72) Inventor: Graham Emmerson, Pelton (GB)

(73) Assignee: PEARSON ENGINEERING LIMITED, Newcastle upon Tyne (GB)

( * ) Notice: Subject to any disclaimer, the term of this patent is extended or adjusted under 35 U.S.C. 154(b) by 0 days.

(21) Appl. No.: 14/567,091

(22) Filed: Dec. 11, 2014

(65) Prior Publication Data

US 2015/0159343 A1 Jun. 11, 2015

(30) Foreign Application Priority Data

Dec. 11, 2013 (GB) ..... 1321946.4

(51) Int. Cl.

| | |
|---|---|
| ***E02F 3/815*** | (2006.01) |
| ***E02F 3/84*** | (2006.01) |
| ***F41H 11/16*** | (2011.01) |
| ***F41H 11/22*** | (2011.01) |
| ***E02F 3/36*** | (2006.01) |
| ***E02F 3/627*** | (2006.01) |
| ***E02F 3/76*** | (2006.01) |

(52) U.S. Cl.

CPC ..... *E02F 3/84* (2013.01); *E02F 3/3636* (2013.01); *E02F 3/3659* (2013.01); *E02F 3/627* (2013.01); *E02F 3/7631* (2013.01); *E02F 3/815* (2013.01); *F41H 11/16* (2013.01); *F41H 11/22* (2013.01)

(58) Field of Classification Search

CPC ..... E02F 3/815

USPC ..... 37/231, 468, 444

See application file for complete search history.

(56) References Cited

U.S. PATENT DOCUMENTS

| | | | | |
|---|---|---|---|---|
| 3,410,008 | A * | 11/1968 | Standfuss | E01H 5/06 37/231 |
| 4,297,074 | A * | 10/1981 | Ballinger | E02F 3/3622 37/444 |
| 4,439,938 | A * | 4/1984 | Grant | B62D 49/02 172/272 |
| 4,813,164 | A * | 3/1989 | Morrell | E02F 3/40 37/231 |
| 4,938,114 | A | 7/1990 | Matthews et al. | |
| 5,111,603 | A * | 5/1992 | Knowlton | E01H 5/06 172/272 |
| 6,526,677 | B1 * | 3/2003 | Bloxdorf | E01H 5/066 37/231 |

(Continued)

FOREIGN PATENT DOCUMENTS

| | | |
|---|---|---|
| CA | 2 733 965 | 9/2012 |
| EP | 2 639 358 | 9/2013 |

(Continued)

OTHER PUBLICATIONS

EP Application 14197392.5-1655, European Search Report, dated Apr. 7, 2015.

(Continued)

*Primary Examiner* — Gary S Hartmann

(74) *Attorney, Agent, or Firm* — Banner & Witcoff, Ltd.

(57) ABSTRACT

A demountable implement (10) for a vehicle has a mounting arrangement (16) for mounting the implement onto a vehicle. The implement is selectively jettisonable from the vehicle and jettison members (42) for jettisoning the implement are provided on or by the implement.

11 Claims, 7 Drawing Sheets

(56) References Cited

U.S. PATENT DOCUMENTS

| | | | | |
|---|---|---|---|---|
| 6,775,933 | B2 * | 8/2004 | Koch | E01H 5/06 37/231 |
| 6,941,685 | B2 * | 9/2005 | Goy | E01H 5/063 172/816 |
| 7,017,288 | B1 * | 3/2006 | Megli | E01H 5/06 172/820 |
| 7,146,754 | B2 * | 12/2006 | Schultz | E01H 5/063 37/231 |
| 7,168,908 | B2 * | 1/2007 | Diaz | E02F 3/3627 37/468 |
| 7,814,689 | B2 * | 10/2010 | Vering | E02F 3/3627 37/468 |
| 8,739,436 | B2 * | 6/2014 | Hill | A01B 59/002 172/817 |
| 2011/0020061 | A1 | 1/2011 | Vering et al. | |
| 2011/0233898 | A1 | 9/2011 | Hembise et al. | |

FOREIGN PATENT DOCUMENTS

| | | |
|---|---|---|
| WO | 2014026676 | 2/2014 |
| WO | 2014026676 A1 | 2/2014 |

OTHER PUBLICATIONS

GB Search Report for GB Serial No. 1321946.4, dated Apr. 30, 2014.

GB Search Report for GB Serial No. 1321946.4, dated Sep. 30, 2014.

* cited by examiner

DEMOUNTABLE VEHICLE IMPLEMENT

FIELD

The present invention relates generally to the attachment of implements and the like to vehicles.

BACKGROUND

There are various situations in which an implement, attachment or the like must be detachably mounted onto a vehicle. For example, military work vehicles often have bulldozer blades fitted to enable earth moving or mine clearance tasks. It is recognised that it may be necessary to jettison implements, either to enable a change to a different type of implement or to allow an implement to be discarded, for example if it is damaged. It is known to provide a jettisoning system in which the means for jettisoning an implement are provided by the vehicle. This allows the use of just one set of the complicated and expensive equipment necessary to eject an implement.

It has been recognised by the present inventors that providing a vehicle-based jettison system has certain limitations.

SUMMARY

According to an aspect of the invention there is provided a demountable implement for a vehicle, the implement comprising mounting means for mounting the implement onto a vehicle, the implement being selectively jettisonable from the vehicle, in which jettison means for jettisoning the implement are provided on or by the implement.

This aspect is based on the principle of providing the necessary means for jettisoning an implement on the implement itself. This allows, for example, an implement to be jettisoned if it develops a fault in use or is otherwise damaged or rendered inactive. The vehicle (or "platform") can then return to a base or depot and collect a replacement implement. It also allows for an implement to be changed, for example for a different type of implement to allow the same vehicle to perform a different task.

The implement may be selected from the group comprising: a blade; a roller; an excavator arm; and a mine plough. For example the implement may be a bulldozer blade.

In some embodiments the implement may be defined as being in the class of "front end equipment" i.e. intended to be fitted to the front end of a vehicle.

The jettison means may comprise one or more jettison pins. The pins (which may be close-fitting) may be intended to be fitted into pin receivers, such as lugs with holes, provided on a vehicle. In some embodiments the pin receivers may be towing eyes and may be pre-existing on the vehicle. In other embodiments dedicated pins receivers are provided on or by the vehicle.

The pins can be used to hold the implement in place and then in use can be removed/withdrawn/ejected/retracted from the lug to release the implement. In some embodiments the pins may be used in conjunction with wedges, abutments or the like to hold the implement in place. In this type of system the wedges hold the implement in position (this may be a 'rattly fit' depending on tolerances), but do not prevent release once the pins are activated.

The jettison means may be at least partly hydraulically and/or electrically and/or pneumatically and/or explosively operated. A hydraulic power pack may, for example, be provided on or by the implement.

There may be some service/s provided by the vehicle, for example electrical power. However, the functionality is provided by the implement.

The implement may include one or more integral jacks. In some embodiments this allows, for example, the implement to be free-standing in such a way that the vehicle can be driven up to and engage the implement without the need for separate lifting equipment.

A further aspect provides a vehicle fitted with an implement as described herein. For example a further aspect provides a military work vehicle fitted with an implement as described herein.

The present invention may provide for a family of interchangeable, jettisonable implements which can be selectively mounted/demounted onto/from a vehicle; and the vehicle itself has no onboard jettisoning capability, it being provided on or by the implement.

A further aspect provides a demountable bulldozer blade comprising mounting means for mounting the implement onto the front of a military work vehicle, the blade being selectively jettisonable from the vehicle, in which onboard jettison means for jettisoning the blade are provided on or by the blade.

A further aspect of the present invention provides a vehicle-to-attachment interface, comprising; a pair of receivers for receiving jettisonable members from an attachment; and a pair of holding members for receiving corresponding wedges from an attachment.

The receivers may comprise lugs, for example in the form of towing eyes or the like.

The holding members may comprise a hook or the like for holding jamming, lodging or wedging the corresponding wedge (or wedge block) on the attachment.

The holding members do not lock the implement in place, but rather hold it in position in combination with the jettisonable members. As a result, in use if the jettisonable members are removed from the receivers then the attachment is released from the vehicle i.e. the holding members do not have to be unlocked.

The jettisonable members may be spaced from each other by a distance in the range 1600 mm to 2000 mm; for example in one embodiment the spacing is approximately 1810 mm.

The holding members may be spaced from each other by a distance in the range 800 mm to 1200 mm; for example in one embodiment the spacing is approximately 1000 mm.

The jettisonable members may be spaced from the holding members in a longitudinal (or "height") direction by a distance in the range 750 mm to 1150 mm; for example in one embodiment the spacing is approximately 950 mm.

With standardised geometry the present invention may allow for a family of interchangeable attachments which can be mounted/demounted onto/from a vehicle.

A further aspect of the present invention provides a vehicle-to-attachment interface, comprising; a pair of lugs for receiving pins on an attachment; and a pair of wedge blocks for receiving wedge blocks on an attachment.

The interface may be formed as an integral part of the vehicle. Alternatively the interface may be formed separately from, and is connectable to, a vehicle.

A further aspect provides a vehicle fitted with an interface as described herein.

Different aspects and embodiments of the present invention may be used separately or together.

BRIEF DESCRIPTION OF THE DRAWINGS

The present invention will now be more particularly described, by way of example, with reference to the accompanying drawings in which.

DETAILED DESCRIPTION OF EXEMPLARY EMBODIMENTS

Figure 1:
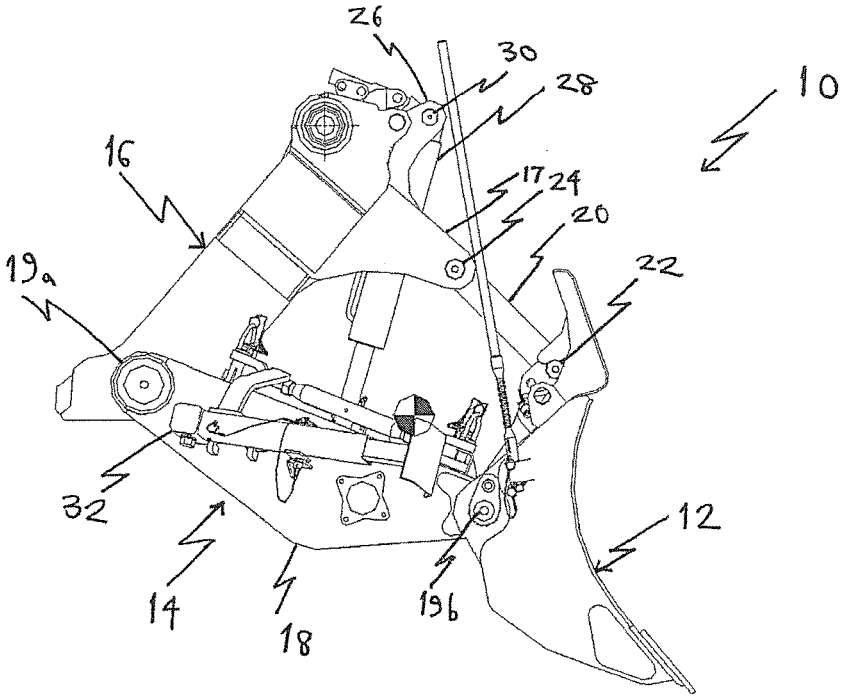
FIG. 1 is a side view of a bulldozer blade assembly formed according to the present invention and shown in a fully open position.

Referring first to FIG. 1 there is shown a bulldozer blade assembly generally indicated 10.

The assembly 30 comprises: a blade 12; an articulation arrangement generally indicated 14; and a mounting arrangement generally indicated 16.

One side of the articulation arrangement 14 is now described in more details, it being understood that a substantially identical arrangement is provided on each side of the assembly. In other embodiments (not shown) one link arrangement is provided (for example centrally) and in others three or more links may be provided.

The blade 12 is pivotally connected to the mounting arrangement 36 via a lower link 18, with a pivot joint 19*a* connecting the link 18 to the mounting arrangement 16 and a pivot joint 39*b* connecting the link 18 to the blade 12.

An upper link 20 is pivotally connected to a mounting lug 17 on the mounting arrangement 16 by a pivot joint 24. The link 20 is connected to the blade 12 by a pivot joint 22.

An actuator link 26 is fixedly connected to the mounting arrangement 16 and carries an actuator piston 28 via a pivot joint 30. The other end of the piston 28 is connected to the lower link 18.

The lower link 38 carries a deploy able jack 32 which allows the assembly 30 to be supported whilst not mounted to a vehicle.

Figure 2:
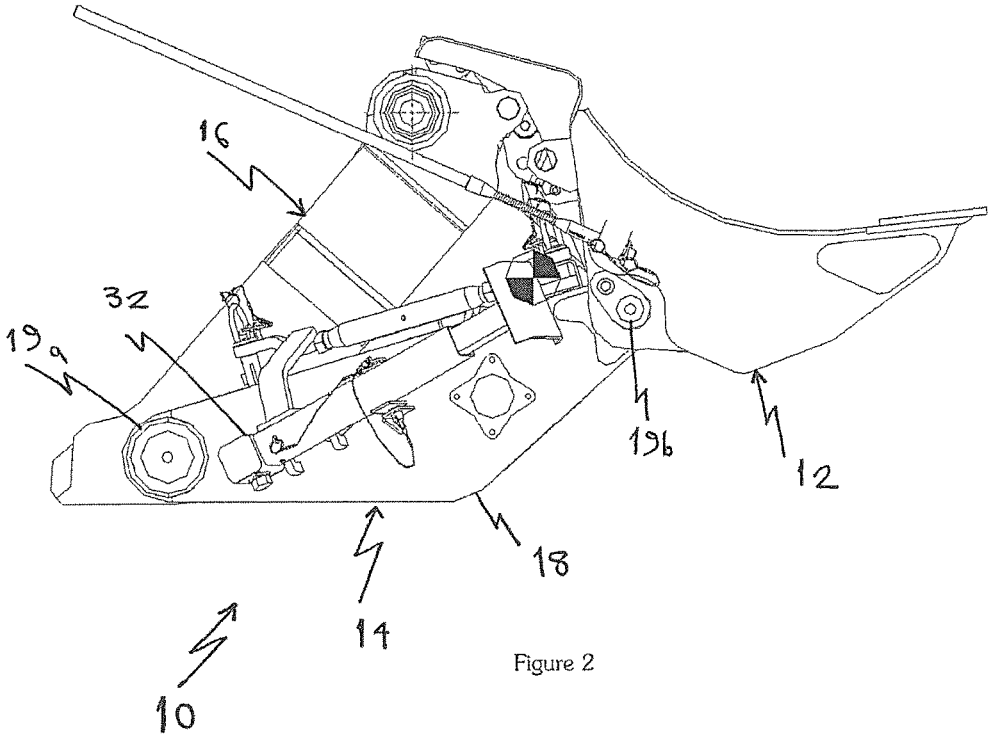
FIG. 2 is a side view of the blade assembly of FIG. 1 shown in a stowed position.
Figure 3:
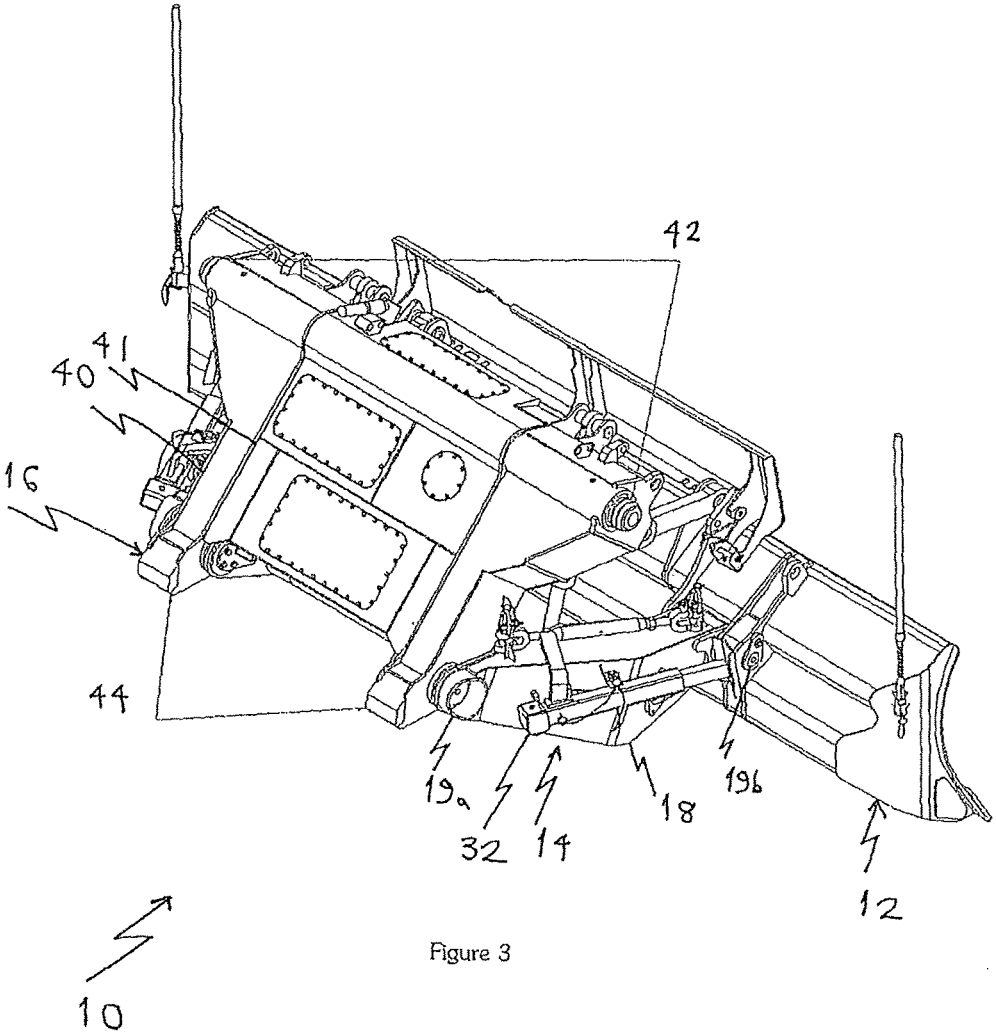
FIG. 3 is a rear isometric view of the blade assembly of FIG. 1.
Figure 4:
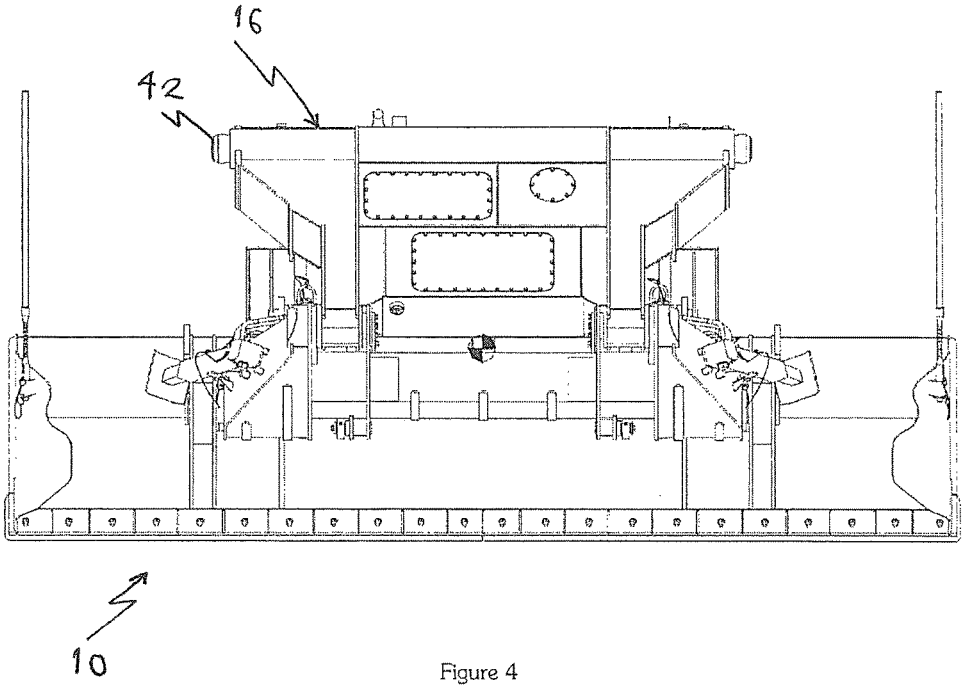
FIG. 4 is a rear view of the blade assembly of FIG. 1.
Figure 5:
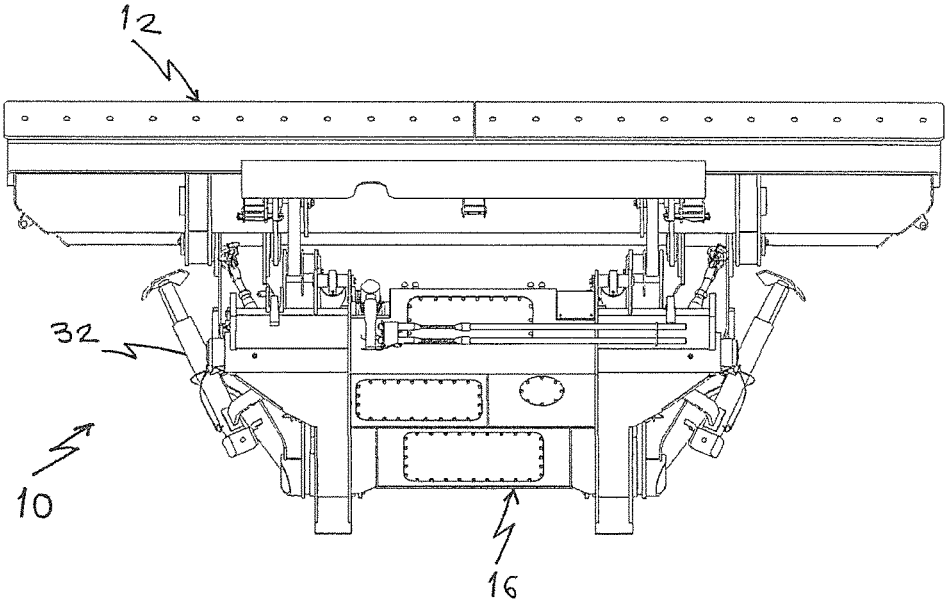
FIG. 5 is a top view of the blade assembly of FIG. 1.

The assembly 30 can be moved between a fully open position (FIG. 1) and a stowed position (FIG. 2). The actuator piston 28 can be used to vary the angle of the blade 12 to allow it to penetrate, move through and be lifted clear of the ground in use. As the piston extends or retracts the blade height changes as well as the orientation.

The mounting arrangement 16 (or mounting plate) comprises a pair of struts 40 joined by a bulkhead 41.

One end (the "upper end") of each strut carries a jettison pin 42. Each pin 42 is hydraulically movable between an extended position (shown) and a retracted position.

The other end (the "lower end") of each strut has a wedge block 44.

The mounting arrangement 18 allows the assembly to be mounted on the vehicle, which has an implement interface as described in more detail below.

Figure 6:
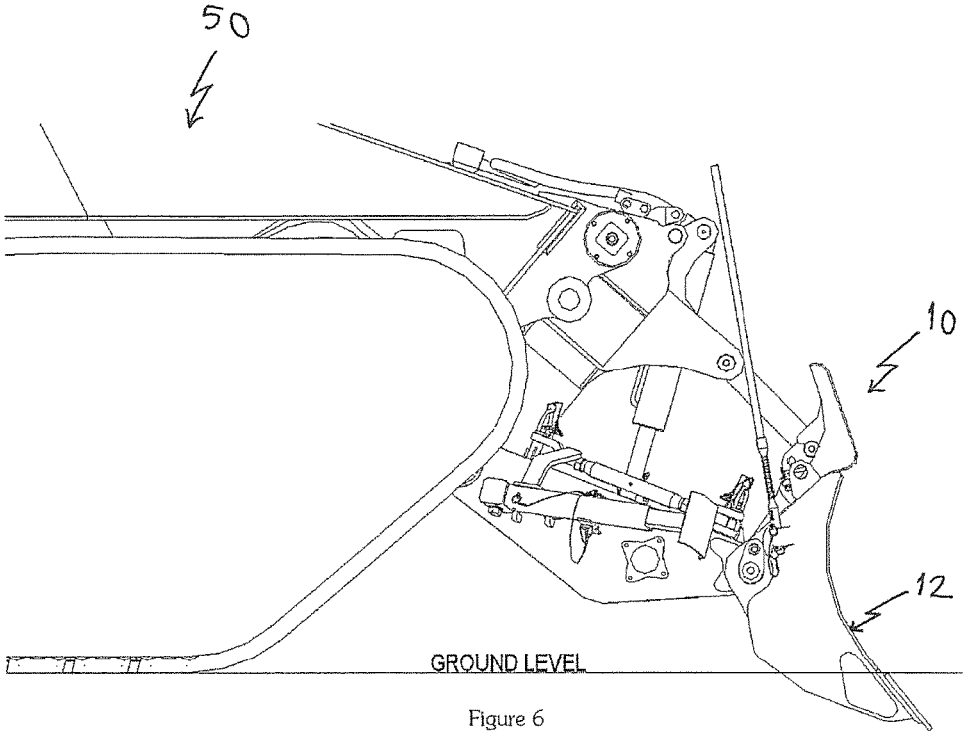
FIG. 6 is a side view showing the blade assembly of FIG. 1 attached to a vehicle.
Figure 7:
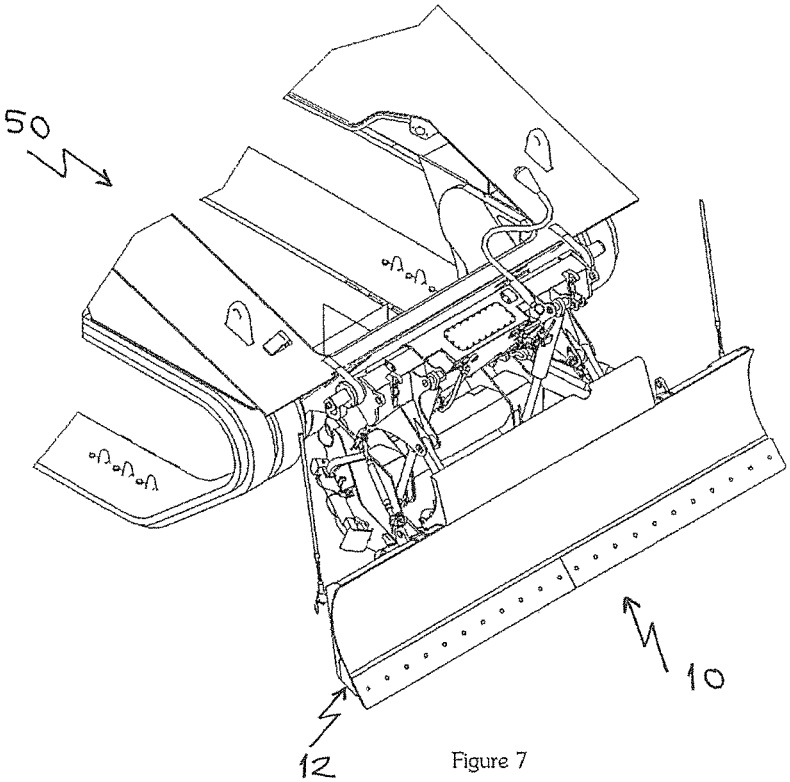
FIG. 7 is an isometric view of the vehicle/blade assembly of FIG. 6.
Figure 8:
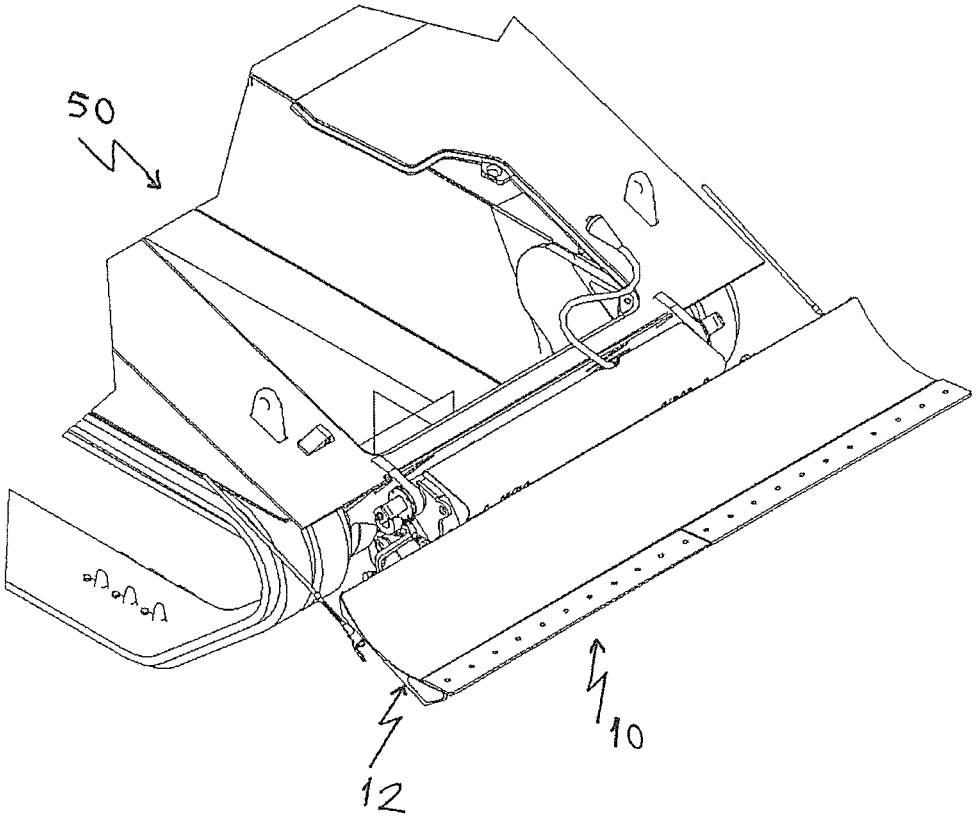
FIG. 8 is an isometric view of the vehicle/blade assembly of FIG. 6 with the blade shown in a stowed position.
Figure 9:
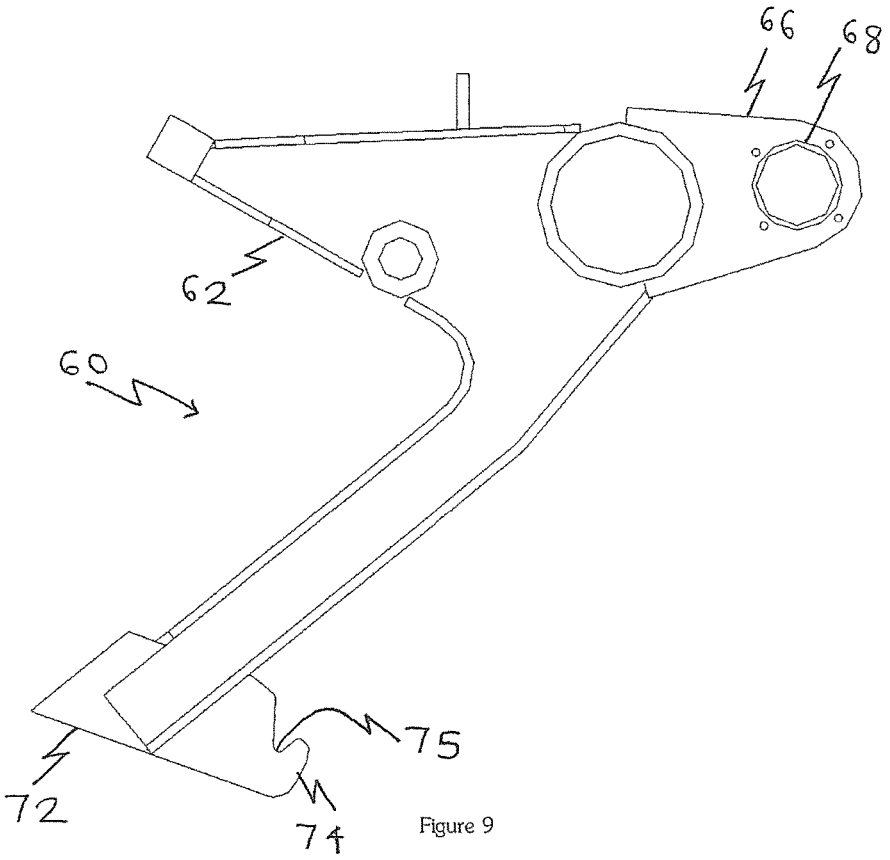
FIG. 9 is a side view of a universal vehicle interface formed according to the present invention.
Figure 10:
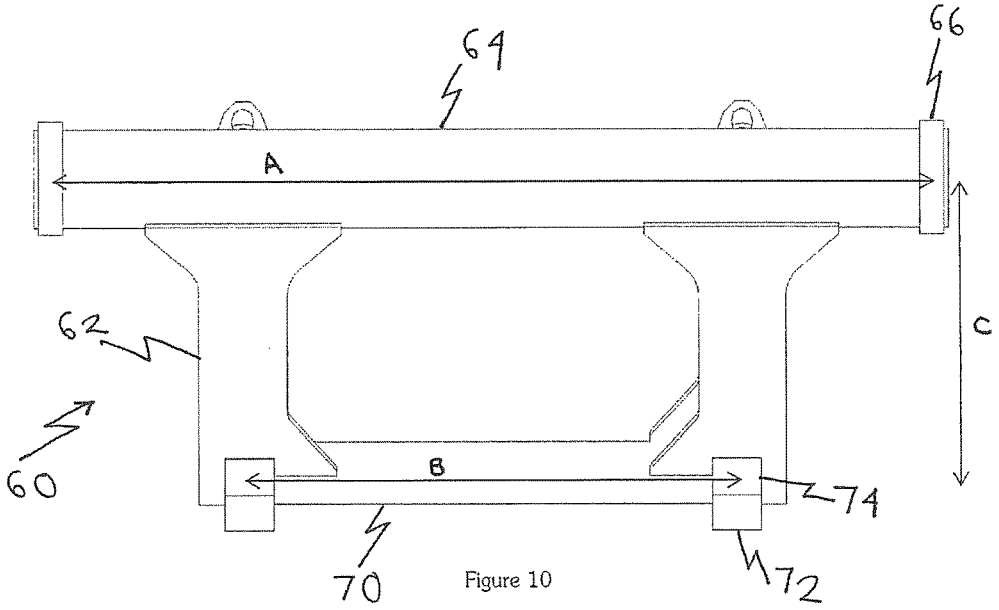
FIG. 10 is a front view of the interface of FIG. 9.
Figure 11:
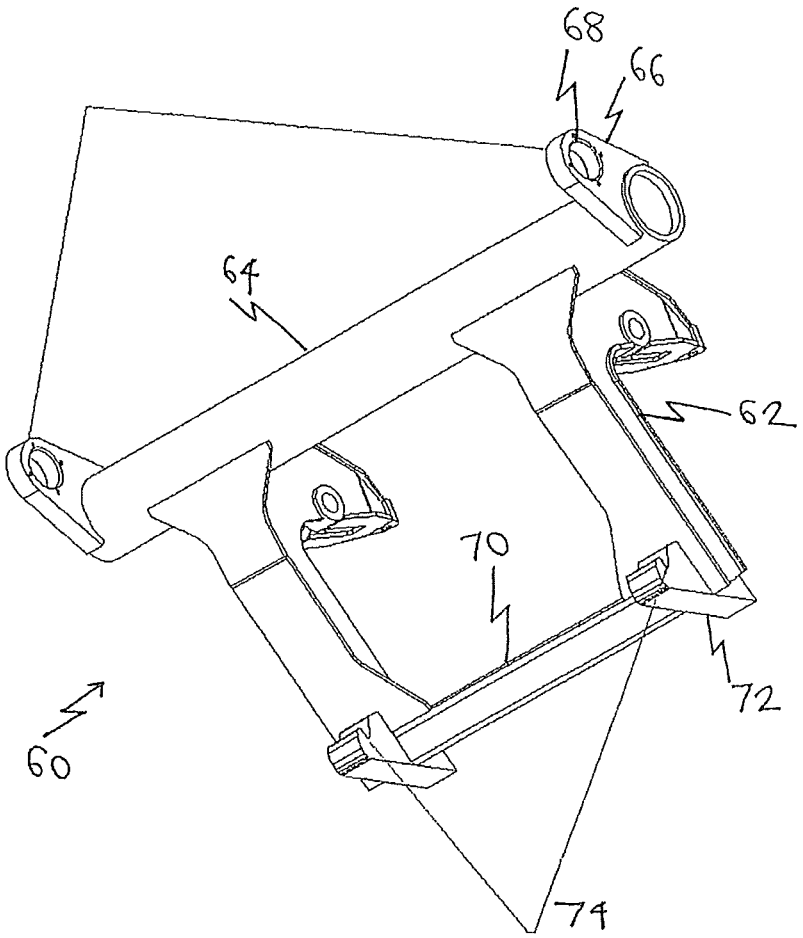
FIG. 11 is an isometric front view of the interface of FIG. 9.

In use the assembly 10 is mounted onto a vehicle 50, as shown in FIGS. 6 to 8. In some embodiments this may be achieved by using a vehicle interface system as described in more detail below.

Referring now also to FIGS. 9 to 31 there is shown a vehicle implement interface generally indicated 60. The interface 60 is fixedly connectable to a vehicle (for example to the front end of a military work vehicle) via a pair of generally L-shape brackets 62. The "top" of the interface includes a cylindrical cross member 64 which extends across the top of the brackets 62 and has at either end a lug 66 with a pin hole 68. The bottom ends of the brackets are joined by a further cross member 70. At either end of the cross member 70 a foot-like member 72 is provided and includes a hook portion 74 which projects away from the vehicle in use.

The geometry of the interface is defined by the relative positions of the holes 68 and the hooks 74, which in the embodiment is: distance A is the distance between the centre points of the holes 68 and is approximately 1810 mm; distance B is the distance between the centre of the hooks 74 and is approximately 1000 mm; distance C is the distance between the centre of the holes 68 and the apex 75 of the hook recess.

In use, the interface 60 is fixed onto a vehicle and the vehicle can then be fitted with a blade of the type described herein, or any other implement or attachment with features corresponding to the lugs 66 and hooks 74 of the interface. More specifically, the blade is rested on its jacks and the vehicle is driven towards it. The vehicle interface hooks 74 engage the mounting arrangement wedge blocks 44 and the assembly 10 turns relative to the interface so that the pins 42 are aligned with the pin holes 68 of lugs 66. Subsequently the pins 42 can be extended into the holes 66 to secure the blade 12 onto the vehicle.

If it is found necessary to remove the blade 12 (for example due to damage, or for some other reason to change the implement fitted) the pins 42 are hydraulically withdrawn from the pin holes 68 of lugs 66. The assembly 10 then falls off the vehicle and the vehicle can be driven away from it. It will be noted that the means for jettisoning the assembly in this way are provided by the assembly itself.

It will be appreciated that the onboard jettison system and the vehicle interface system described herein could be used together or separately.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A vehicle-to-implement interface and implement combination, the interface suitable for receiving the implement, the implement comprising a mounting arrangement for mounting on a vehicle, the mounting arrangement comprising jettison members and wedges or abutments, the jettison means being provided on or by the implement for jettisoning the implement from a vehicle and being used in conjunction with the wedges or abutments which hold the implement in position in combination with the jettison members but do not prevent release if the jettison means is activated, whereby when the jettison members are activated the implement falls off the vehicle;

the interface comprising a pair of receivers for receiving the jettisonable members from the implement; and a pair of holding members for receiving the corresponding wedges or abutments from the implement.

2. The combination as claimed in claim 1, in which the receivers are spaced from each other by a distance in the range 1600 mm to 2000 mm.

3. The combination as claimed in claim 1, in which the holding members are spaced from each other by a distance in the range 800 mm to 1200 mm.

4. The combination as claimed in claim 1, in which the receivers are spaced from the holding members in a longitudinal direction by a distance in the range 750 mm to 1150 mm.

5. The combination as claimed in claim 1, comprising; a pair of lugs for receiving pins on an attachment; and a pair of wedging members for receiving wedges on the implement.

6. The combination as claimed in claim 1, in which the interface is formed as an integral part of the vehicle.

7. The combination as claimed in claim 1, in which the interface is formed separately from, and is connectable to a vehicle.

8. The combination of claim 1, wherein the jettisonable members comprise one or more jettison pins.

9. The combination of claim 1, wherein the jettisonable members are at least partly hydraulically, electrically, pneumatically, and/or explosively operated.

10. A vehicle fitted with a combination according to claim 1.

11. The combination of claim 1 wherein the implement comprises a pair of brackets for fixing the interface to a vehicle, the interface further comprising a top end and a bottom end, a first cross member is provided at the top end, the first cross member comprising one of the pair of receivers at each end, each receiver comprising a lug, each of the lugs including a jettison pin hole, a second cross member provided at the bottom end, the second cross member comprising one of the pair of holding members at each end, each holding member comprising a foot-like member, each of said foot-like members including a hook portion.

* * * * *